United States Patent [19]

Metcalfe

[11] Patent Number: 4,647,943

[45] Date of Patent: Mar. 3, 1987

[54] MESH DISH ANTENNA AND HUB

[75] Inventor: Richard J. Metcalfe, Tillsonburg, Canada

[73] Assignee: General Instrument Corporation, New York, N.Y.

[21] Appl. No.: 717,360

[22] Filed: Mar. 29, 1985

[51] Int. Cl.[4] ..... H01Q 19/02; H01Q 19/14

[52] U.S. Cl. ..... 343/916; 343/915; 343/840

[58] Field of Search ..... 343/915, 916, 840

[56] References Cited

U.S. PATENT DOCUMENTS

| | | | |
|---|---|---|---|
| 2,181,181 | 11/1939 | Gerhard | 343/916 |
| 2,945,234 | 7/1960 | Driscoll | 343/915 |
| 4,568,945 | 2/1986 | Winegard et al. | 343/916 |
| 4,578,682 | 3/1986 | Hooper et al. | 343/916 |

*Primary Examiner*—Daniel M. Yasich
*Attorney, Agent, or Firm*—Barry R. Lipsitz

[57] ABSTRACT

The ribs of a mesh-type parabolic antenna or the like are clamped in a radial arrangement between the side walls of adjacent wedges in a hub. The hub includes a plate with a flange extending from the interior thereof. The wedges are arranged on the plate radially about the circumference of the flange. Each wedge has side walls tapering inwardly toward a front end thereof. The front ends of the wedges are drawn toward the flange and fastened thereto, thereby clamping the ribs therebetween. Each of the ribs includes a channel, and a plurality of locking strips are provided for insertion into the rib channels. Antenna mesh panels bridging adjacent ribs are held to the ribs at the panel edges by the locking strips.

12 Claims, 10 Drawing Figures

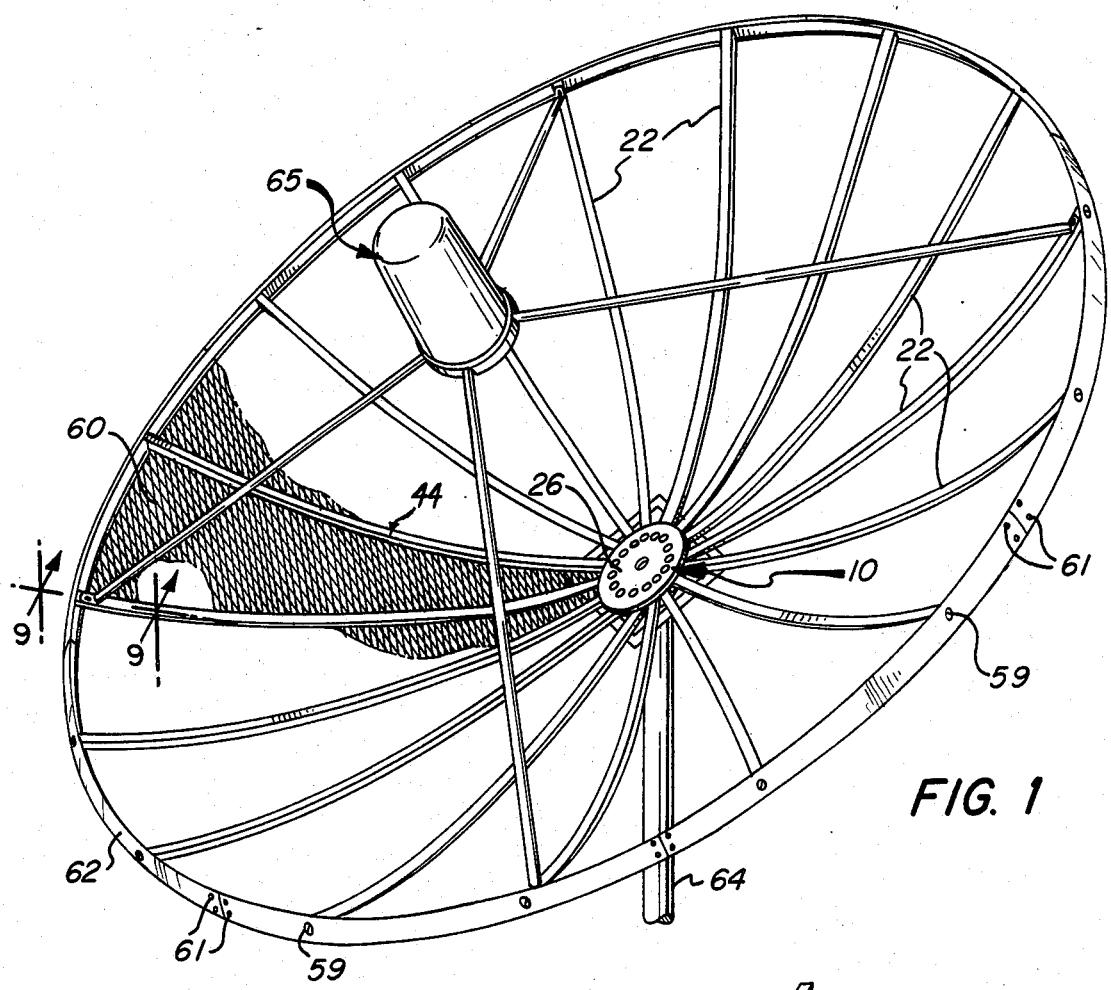
FIG. 1
FIG. 2
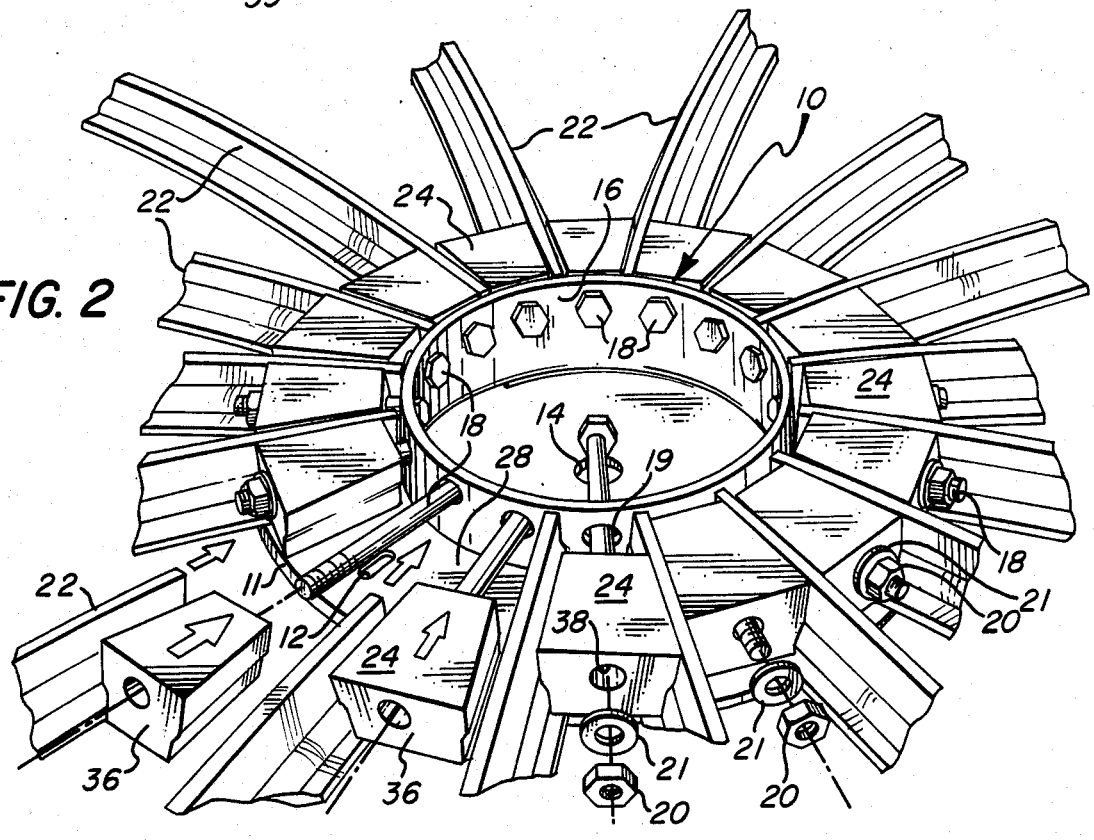

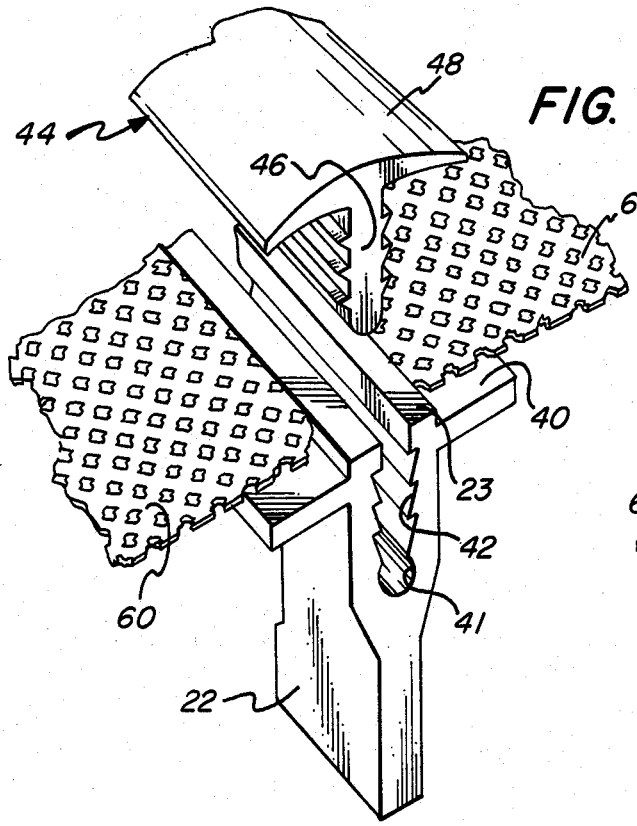
FIG. 7
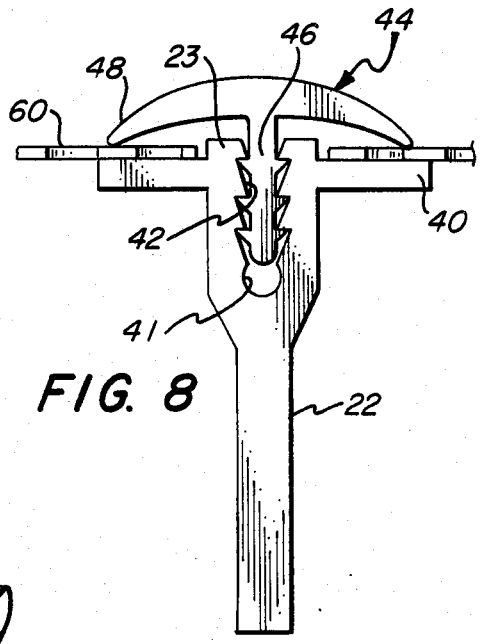
FIG. 8
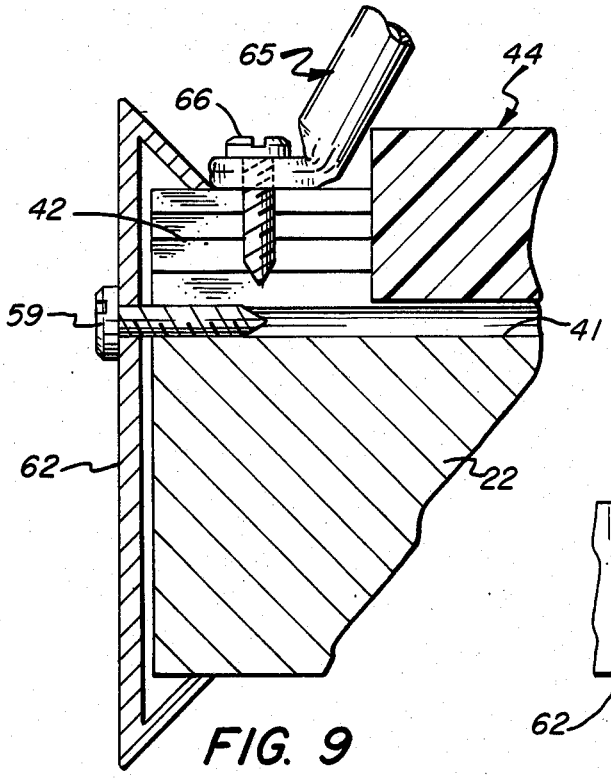
FIG. 9
FIG. 10
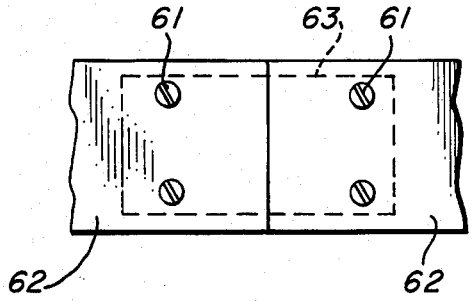

MESH DISH ANTENNA AND HUB

FIELD OF THE INVENTION

The present invention relates to antennas and more particularly, to a mesh dish antenna and hub for assembling the antenna.

BACKGROUND OF THE INVENTION

Mesh dish antennas are used in a variety of communication applications, such as satellite television systems where signals are transmitted at microwave frequencies. The availability of satellite television channels has spawned a proliferation of such antennas for home use, particularly in rural settings where cable television is not available.

The structure and geometry of such antennas is critical in order to provide acceptable reception. The structure of such antennas generally includes a plurality of ribs radially extending from a center hub, having a signal reflecting mesh attached thereto. In order to provide the necessary angular precision between ribs and maintain the proper overall parabolic arrangement thereof, it has been necessary in the past to assemble mesh dish antennas for home use at the factory, and ship them in the assembled condition to the end user for installation at his or her home.

It would be advantageous to provide a mesh dish antenna which can be shipped in pieces and easily assembled by one person on-site. Such an antenna must be durable and lightweight, yet must provide structural integrity. The parabolic ribs which form the dish must be accurately held in correct relation to one another, and replacement of any number of parabolic ribs or mesh panels without complete disassembly or dismounting of the antenna should be provided. It would be further advantageous if such structure did not require any holes or other weak points where the parabolic ribs are joined at the antenna hub.

The present invention provides such a structure.

SUMMARY OF THE INVENTION

In accordance with the present invention, a hub is provided for accurately locating and securing the ribs of a mesh-type parabolic antenna or the like. The hub includes a plate and a flange extending from the interior of the plate. A plurality of wedges are provided on the plate. The wedges have side walls which taper inwardly toward a front end thereof. Fastening means are provided for drawing the front ends of the wedges toward the flange, and fastening the wedges to the flange in a radial arrangement thereabout. In this manner, the side walls of adjacent wedges provide a clamping arrangement enabling radially extending ribs to be mounted to the hub.

The fastening means of the hub can comprise a plurality of openings arranged about the circumference of the flange, each opening in alignment with a corresponding bore in the front end of a different wedge. A plurality of threaded fasteners is provided, each passing into a different one of the openings and the corresponding bore. When the threaded fasteners are tightened, the wedges are drawn toward the flange. Means can further be provided for anchoring each of the wedges to the plate. Further, the side walls of the wedges can be shaped to conform with the corresponding edges of the ribs to be clamped thereagainst, thereby ensuring structural integrity.

A novel arrangement for mounting mesh panels to the ribs of a mesh-type parabolic antenna is also disclosed. A channel is provided in each of the ribs, together with a plurality of locking strips. Each locking strip has a tab portion for holding mesh against a rib and a tail portion for interlocking engagement with a rib channel. Mesh panels which bridge adjacent ribs are held to the ribs at the panel edges by locking strips retained in the rib channels. The locking strips can be flexible for conformance with the shape of the ribs. Further, the channels can be oriented such that the depth thereof projects into the ribs perpendicularly to the dish surface. The strips and ribs can be generally T-shaped, although other shapes will be apparent to those skilled in the art. In any case, the channels can run throughout the entire length of the ribs, with a locking strip installed on each rib and extending for substantially the entire length of the rib. The tail portion of each locking strip can include a plurality of teeth for interlocking engagement with corresponding teeth in the rib channel mated therewith.

BRIEF DESCRIPTION OF THE DRAWINGS

FIG. 1 is a perspective view of a mesh dish antenna constructed in accordance with the present invention;

FIG. 2 is an exploded perspective view of the antenna hub showing the assembly of wedges and ribs into the hub;

FIG. 7 is an exploded perspective view showing how mesh panels are mounted to the antenna ribs using a locking strip;

FIG. 8 is an end view showing the mesh, rib, and locking strip arrangement of FIG. 7;

FIG. 9 is a cross-sectional view taken along the lines 9—9 of FIG. 1 illustrating the installation of a circular rim around the perimeter of the antenna dish; and FIG. 10 is a plan view showing how butted ends of the outer rim are held together.

DETAILED DESCRIPTION OF THE INVENTION

Figure 3:
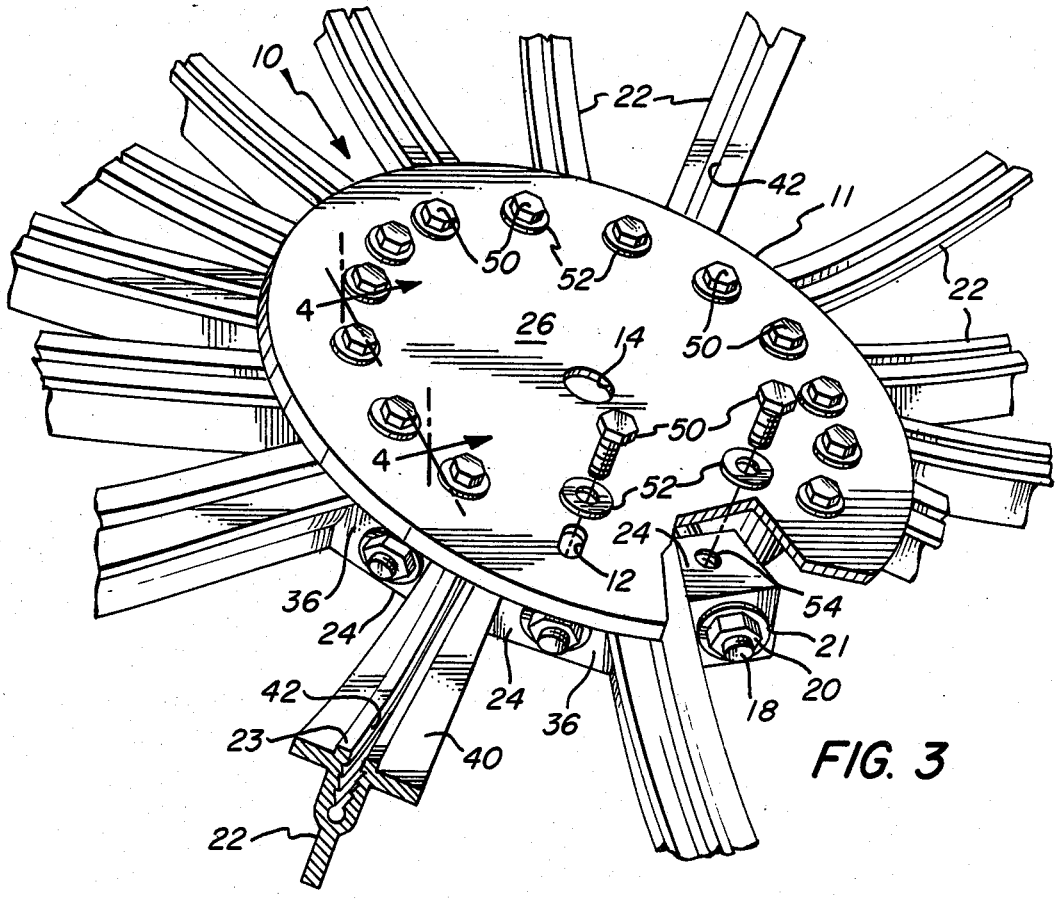
FIG. 3 is an exploded perspective view of the face of the antenna hub with ribs radially extending therefrom.

FIG. 1 illustrates a mesh dish antenna having a plurality of curved ribs 22 radially extending from a hub 10. A plurality of mesh panels 60 extend between adjacent ribs to form a mesh dish. Mesh panels 60 can, for example, be fabricated from expanded aluminum hex or diamond mesh or other screen materials. A rim 62 extends around the circumference of the mesh dish, and is secured to ribs 22 with screws 59. An antenna mast 64 allows the antenna to be mounted to a foundation (not shown). A quadrapod feed support 65 is also provided.

Figure 4:
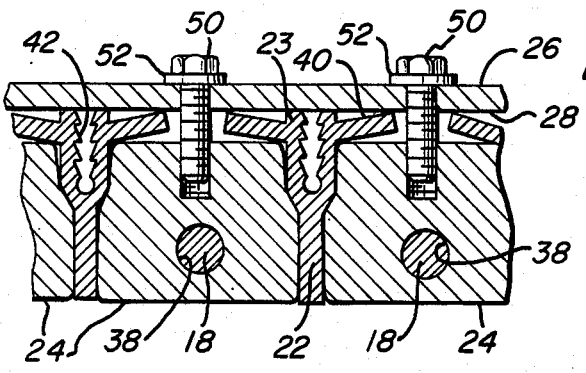
FIG. 4 is a cross-sectional view taken along the lines 4—4 of FIG. 3 showing how ribs are clamped between adjacent wedges.
Figure 5:
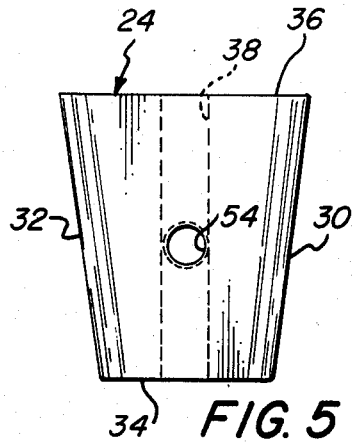
FIG. 5 is a top plan view of a wedge used in the antenna hub.
Figure 6:
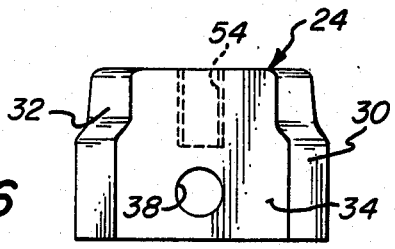
FIG. 6 is an end view of the wedge shown in FIG. 5.

The novel hub structure of the antenna is shown in FIGS. 2–4, with additional views of the hub wedges shown in FIGS. 5 and 6. Hub 10 includes a plate 11 with a flange 16 extending from the interior thereof. A plurality of elongated holes 12 are arranged in a circle around plate 11. A center hole 14 is provided for possible use in mounting a centrally located amplifier and feed, which would be used instead of quadrapod feed support 65. Other variations for centrally mounting the amplifier will be apparent to those skilled in the art.

A plurality of wedges 24 are assembled on plate 11 around the outer perimeter of flange 16. Each wedge 24 includes side walls 30, 32 which taper inwardly from a rear end 36 toward a front end 34 of the wedge. The number of wedges in the hub is equal to the number of parabolic ribs 22 needed for the dish antenna.

A plurality of openings 19 are arranged about the circumference of rlange 16. Each opening 19 is in alignment with a corresponding bore 38 passing through a different one of wedges 24. Threaded fasteners, namely bolts 18 and nuts 20, are provided to secure the wedges 24 to flange 16. Each bolt 18 passes into a different one of openings 19 and the corresponding bore 38. Upon tightening the threaded fastener arrangement, the front ends of wedges 24 are drawn toward flange 16, thereby fastening the wedges to the flange in a radial arrangement thereabout. Washers 21 are provided between nuts 20 and the rear ends 36 of wedges 24. The sides of adjacent wedges 24 form clamps to hold ribs 22 securely in the hub.

A threaded hole 54 is provided on the top of each wedge 24. Thus, bolts 50 can be inserted through holes 12 in plate 11, and screwed into the threaded holes 54 to anchor each of wedges 24 to plate 11. Washers 52 are provided between the heads of bolts 50 and the front face 26 of plate 11.

In the embodiment illustrated, ribs 22 have a generally T-shaped cross-section (FIG. 8). Sides 30, 32 of wedges 24 are shaped to conform with the sides of the T-shaped ribs 22 to provide a high degree of structural integrity to the antenna. A lip 23 extends from the top portion 40 of each rib 22, to provide an edge against which mesh panels 60 will butt when the panels are installed as described below. The top portion 40 of the T-shaped ribs 22 is sandwiched between wedges 24 and the back face 28 of plate 11, also providing structural integrity. As shown in FIG. 4, the top portions 40 of ribs 22 may deflect slightly toward plate 11 as wedges 24 are tightened in hub 10.

Ribs 22 include a channel 42 extending throughout the length thereof. A semicircular portion 41 at the bottom of each channel 42 is provided for self-tapping screws 59 (FIG. 1) which mount rim 62 to the outer edges of ribs 22. Rim 62 is constructed from a plurality of rib sections which are butted together at their edges and secured using screws 61 and butt plates 63 as shown in FIG. 10. As shown in FIG. 9, quadrapod support 65 is mounted to the antenna structure via self-tapping screws 66 which are screwed into channels 42 at the edges of four equally spaced ribs.

FIGS. 7 and 8 depict the mounting of the antenna mesh to the rib structure. As already noted, each rib 22 is provided with a channel 42 which extends across its length. The antenna mesh is provided in pie-shaped panels 60 which span adjacent ribs. The edges of panels 60 butt against lips 23 and are supported by the top sections 40 of ribs 22. In addition to providing an edge to locate panels 60, lips 23 serve the further purpose of providing room for the panel edges to flex in severe weather conditions, without abrading and wearing through the tab portions 48 of locking strips 44 described below.

A locking strip 44 is provided for each rib 22. The locking strips are of substantially the same length as ribs 22, and can be made from a flexible plastic material (e.g., high strength PVC) so that they conform with the curved shape of the ribs. In the embodiment illustrated, locking strips 44 comprise a tab portion 48 with a tail portion 46 extending therefrom. The tail portion 46 of each locking strip includes a plurality of teeth for interlocking engagement with corresponding teeth in the rib channel 42. In order to install the mesh panels 60 on the rib structure, the panels are placed on the ribs and the tail portions 46 of the locking strips are inserted into channels 42 by, for example, driving them into place with a soft mallet. Mesh panels 60 will then be sandwiched between tabs 48 of the locking strips 44 and top portions 40 of the ribs 22. If necessary, locking strips 44 can be peeled out of the rib channels 42 to enable repair or replacement of individual mesh antenna panels without disassembling the entire antenna.

It should now be appreciated that the present invention provides a mesh dish antenna assembly far superior to those previously known. In particular, the present structure enables shipping of an antenna in disassembled form, and subsequent assembly thereof by one person on the final antenna site. The parabolic ribs for the antenna are accurately held in correct relation to one another by the clamping action of adjacent wedges 24. Secure clamping is assured as the wedges are drawn toward flange 16 of hub 10 when fastening bolts 18 are tightened. Bolts 50 anchor wedges 24 to plate 11, thereby enhancing the antenna's structural integrity. The hub structure maintains the top portions 40 of ribs 22 in place against the back face 28 of plate 11, and thus ensures that the parabola formed by the ribs will be precise. The wedges maintain accurate angular spacing of the ribs.

A further advantage of the wedge structure is that no holes or other weak points are required in the inner ends of the parabolic ribs to mount the ribs to the antenna hub. Still further, any number of parabolic ribs or mesh panels can be replaced without complete disassembly or dismounting of the antenna.

In a preferred embodiment, ribs 22 and wedges 24 are of cast aluminum alloy construction. However, other materials and methods of manufacture can be used to produce the antenna components. Further, although a T-shaped cross-section is illustrated for ribs 22, many other rib shapes can be used, including solid, hollow and complex shaped forms.

I claim:

1. A hub for accurately locating and securing the ribs of a mesh type parabolic antenna or the like comprising:

a plate;

a substantially circular flange extending from the interior of said plate;

a plurality of wedges each having a bottom wall adajcent said plate, said wedges having side walls tapering inwardly toward a front end thereof; and means for drawing the front ends of each of said wedges toward said flange and fastening the wedges to the flange in a radial arrangement thereabout, the side walls of adajcent pairs of wedges forming clamps to enable radially extending ribs to be mounted to the hub.

2. The hub of claim 1 wherein said fastening means comprises:

a plurality of openings arranged about the circumference of said flange, each opening in alignment with a corresponding bore in the front end of a different one of said wedges; and a plurality of threaded fasteners, each passing into a different one of said openings and the corresponding bore;

whereby the wedges are drawn toward the flange as the threaded fasteners are tightened.

3. The hub of claim 2 further comprising:

means for anchoring each of said wedges to said plate.

4. The hub of claim 1 wherein the side walls of said wedges are shaped to conform with the corresponding sides of ribs to be clamped thereagainst.

5. A mesh dish antenna assembly comprising:

a hub including:

a plate;

a substantially circular flange extending from the interior of said plate;

a plurality of wedges each having a bottom wall adjacent said plate, said wedges having side walls tapering inwardly toward a front end thereof; and fastening means for drawing the front ends of said wedges toward said flange and fastening wedges to the flange in a radial arrangement thereabout; and a plurality of ribs, each rib installed between the adjacent side walls of a different pair of wedges;

whereby the ribs are clamped to the hub in a radially extending manner as the front ends of said wedges are drawn toward said flange.

6. The assembly of claim 5 wherein said ribs each have a cross-section which conforms to the shape of the space between the side walls of adjacent wedges.

7. The assembly of claim 5 wherein each of said ribs has a portion thereof which is sandwiched between said plate and at least one of the wedges that clamps the rib to the hub.

8. The assembly of claim 5 further comprising means for mounting mesh panels over the radially extending ribs.

9. The assembly of claim 8 wherein said mesh mounting means comprises:

a channel in each of said ribs; and a plurality of locking strips, each strip having a tab portion for holding mesh against a rib and a tail portion for interlocking engagement with a rib channel;

whereby mesh panels bridging adjacent ribs are held to the ribs at the panel edges by locking strips retained in the rib channels.

10. The assembly of claim 9 wherein said locking strips are flexible for conformance with the shape of the ribs.

11. The assembly of claim 10 wherein said fastening means comprises:

a plurality of openings arranged about the circumference of said flange, each opening in alignment with a corresponding bore in the front end of a different one of said wedges; and a plurality of threaded fasteners, each passing into a different one of said openings and the corresponding bore;

whereby the wedges are drawn toward the flange as the threaded fasteners are tightened.

12. The assembly of claim 11 further comprising:

means for anchoring each of said wedges to said plate.

* * * * *